US006986184B1

(12) United States Patent
Chamblee et al.

(10) Patent No.: US 6,986,184 B1
(45) Date of Patent: Jan. 17, 2006

(54) BRUSH DEVICE

(76) Inventors: Rebecca Chamblee, 2406 Highway 278 E., Hokes Bluff, AL (US) 35903; James T. Chamblee, 2406 Highway 278 E., Hokes Bluff, AL (US) 35903

( * ) Notice: Subject to any disclaimer, the term of this patent is extended or adjusted under 35 U.S.C. 154(b) by 0 days.

(21) Appl. No.: 10/905,790

(22) Filed: Jan. 20, 2005

(51) Int. Cl.
*A46B 13/02* (2006.01)
*B08B 9/02* (2006.01)

(52) U.S. Cl. ..... 15/23; 15/88; 15/104.04; 15/104.05

(58) Field of Classification Search ..... 15/23, 15/88, 104.03, 104.04, 104.05
See application file for complete search history.

(56) References Cited

U.S. PATENT DOCUMENTS

| | | | | | |
|---|---|---|---|---|---|
| 490,682 | A | * | 1/1893 | Roemer | 15/191.1 |
| 2,962,739 | A | * | 12/1960 | Schoch | 15/23 |
| 3,076,988 | A | * | 2/1963 | Mills | 15/56 |
| 3,233,271 | A | | 2/1966 | Charvat | |
| 3,965,521 | A | | 6/1976 | Wardell | |
| 4,014,063 | A | * | 3/1977 | Bunke | 15/111 |
| 4,217,671 | A | | 8/1980 | Rand | |
| 4,461,052 | A | | 7/1984 | Mostul | |
| 4,862,549 | A | * | 9/1989 | Criswell et al. | 15/104.04 |
| 5,269,104 | A | * | 12/1993 | DiBiagio | 451/344 |
| 5,307,534 | A | * | 5/1994 | Miller | 15/4 |
| 5,336,012 | A | | 8/1994 | Newville | |
| 5,911,256 | A | | 6/1999 | Tsai | |
| 5,960,503 | A | | 10/1999 | Del Pozo Y Mattei | |
| 6,757,929 | B1 | * | 7/2004 | Snelson | 15/104.05 |

* cited by examiner

*Primary Examiner*—Randall Chin
(74) *Attorney, Agent, or Firm*—Donald R. Schoonover

(57) ABSTRACT

A brush device has a plurality of different size annular brushes encircling a single cylindrical brush. All brushes are mounted on a drive shaft associated with an electric motor which can be powered by a battery pack or by utility power. The cylindrical brush will fit into a water jet, while the annular brushes will clean the outside of the water jet. A brush head encircles the annular brushes and is located and shaped to engage a planar surface adjacent to the water jet being cleaned.

2 Claims, 1 Drawing Sheet

BRUSH DEVICE

BACKGROUND OF THE INVENTION

The present invention relates to the general art of brushing, scrubbing and general cleaning, and to the particular field of rotary handle mounted brushes.

Many people have water jets in various devices. For example, many people have water jets in a bath tub, or in a hot tub, or the like. These water jets must be cleaned on a periodic basis. However, some of the jets may be difficult to reach. Still further, it is often difficult to clean inside the water jet as well as around the water jet.

Therefore, there is a need for a means for cleaning in and around a water jet.

Some water jets are quite small and it is very difficult to clean inside such jets. Small brushes, such as tootbrushes, do not do an adequate job, and may be difficult to maneuver, especially for someone who may have some disability.

Therefore, there is a need for a means for cleaning in and around a small or difficult to reach water jets.

Many appliances have a variety of water jets associated therewith. Some of these water jets may be larger than others. Thus, one size or shape for a brush may not be adequate to complete a jet cleaning task.

Therefore, there is a need for a means for cleaning a variety of water jets.

Often, the area around a water jet must be cleaned at the same time the water jet, itself, is cleaned. Thus, the wall in which a water jet is mounted should be cleaned when the water jet is cleaned so a complete job is performed. However, due to the difference in shape and size between a planar wall and a small water jet, several different cleaning implements may be required. This may be cumbersome and time consuming to the worker.

Therefore, there is a need for a means for cleaning a variety of water jets as well as the areas associated with the water jets.

Any device such as a water jet cleaner should be easy to use and easily manipulated. If the device is cumbersome, it will not be commercially accepted.

Therefore, there is a need for a means for cleaning a variety of water jets as well as the areas associated with the water jets and which is easy to use and manipulate.

PRINCIPAL OBJECTS OF THE INVENTION

It is a main object of the present invention to provide a means for cleaning in and around a water jet.

It is another object of the present invention to provide a means for cleaning in and around a small or difficult to reach water jet.

It is another object of the present invention to provide a means for cleaning a variety of water jets.

It is another object of the present invention to provide a means for cleaning a variety of water jets as well as the areas associated with the water jets.

It is another object of the present invention to provide a means for cleaning a variety of water jets, including both large and small water jets, as well as the areas associated with the water jets and which is easy to use and manipulate.

SUMMARY OF THE INVENTION

These, and other, objects are achieved by a brush device that has a plurality of annular brushes encircling a single cylindrical brush. The annular brushes are of different sizes.

All brushes are mounted on a drive shaft associated with an electric motor. The cylindrical brush will fit into a water jet, while the annular brushes will clean the outside of the water jet. A brush head encircles the annular brushes and is located and shaped to engage a planar surface adjacent to the water jet being cleaned. The brush can be plugged into a battery pack or into a wall outlet to provide power for the motor.

Using the brushing device embodying the present invention will permit a user to clean a variety of water jets, both inside the jets and outside the jets as well as the areas surrounding the water jets using a single, easy-to-use and easy-to-manipulate device.

BRIEF DESCRIPTION OF THE DRAWING FIGURES

DETAILED DESCRIPTION OF THE PREFERRED EMBODIMENT

Figure 2:
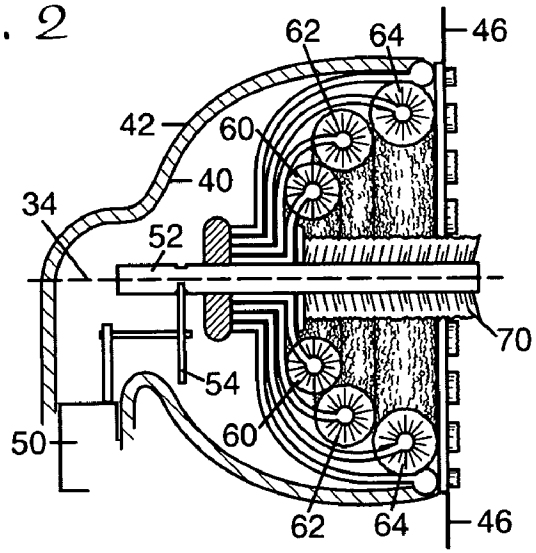
FIG. 2 is an elevational view taken along line 2—2 of FIG. 1.

Other objects, features and advantages of the invention will become apparent from a consideration of the following detailed description and the accompanying drawings.

Referring to the Figures, it can be understood that the present invention is embodied in a brush device 10 which achieves the above-stated objectives.

Brush device 10 comprises a housing 12 which has a handle 14 and a head 16. Handle 14 is hollow and can be used to store a battery or like power unit. An on/off switch 18 is also located on handle 14. Head 16 is frusto-conical in shape and has a frustum end 30, a base end 32, and an axis 34 which extends between frustum end 30 and base end 32. Head 30 is hollow and has an interior surface 40 and an exterior surface 42. An opening 44 is defined at base end 32 and is contained in a plane 46. An annular surface 48 is located on head 30 and encircles opening 44.

An electric motor 50 is located inside the housing 12 and has a drive shaft 52 associated therewith. As shown in FIG. 2, motor 50 is at an angle with respect to drive shaft 52 and thus a gear mechanism 54 is used. However, the motor 50 and the drive shaft 52 can be coupled together in a manner that does not require gear mechanism 54, if suitable, by simply locating motor 50 in head 16 rather than in handle 14 as shown in FIG. 2. Drive shaft 52 extends along axis 34 from inside housing 12 toward opening 44. As shown in FIG. 2, drive shaft 52 extends through opening 44 out of head 16.

A plurality of annular brushes 60, 62 and 64 are mounted on drive shaft 52 for rotation therewith. The annular brushes are of different diameters, with brush 64 being the largest and being located adjacent to opening 44 and brush 60 being the smallest annular brush and being located farthest from opening 44. As can be understood from FIG. 2, each annular brush is smaller than those annular brushes that are located closer to the opening 44 than the annular brush of interest.

A cylindrical brush 70 is mounted on drive shaft 52 for rotation therewith. Cylindrical brush 70 is located centrally of each of the annular brushes and extends in the direction of axis 34 out of opening 44.

The brushes can be removed and changed as desired. Furthermore, while unit 10 is primarily useful for cleaning water jets, it can also be used to clean faucets, drains and the like.

A plurality of cleaning bristles 74 are mounted on housing 12 in surrounding relationship with opening 44.

Figure 1:
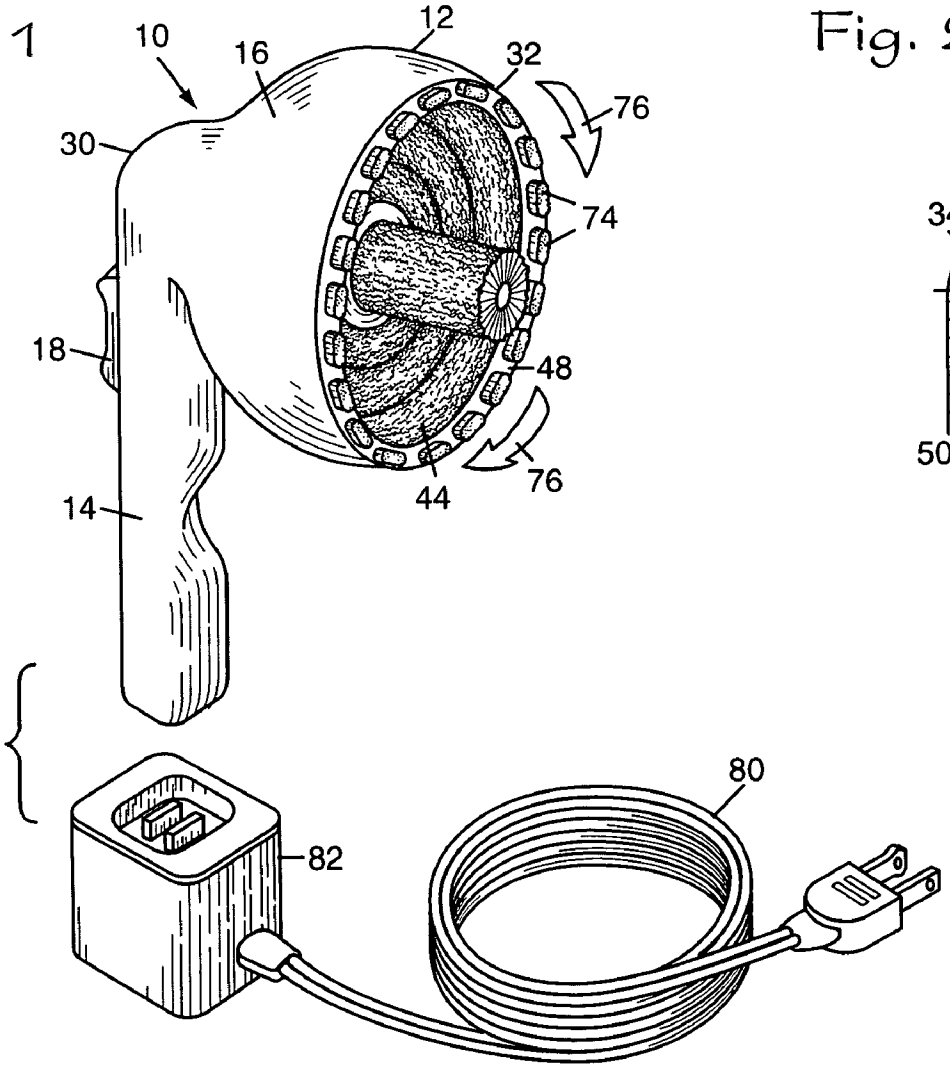
FIG. 1 is a perspective view of a brush unit embodying the present invention.

As indicated in FIG. 1, when motor 50 is activated, the brushes rotate in the clockwise direction 76 indicated in FIG. 1. Cylindrical brush 70 will fit into a water jet to clean the inside of the water jet while annular brushes 60–64 will contact the outside of the water jet. Brushes 60–64 are of different sizes so water jets of different outside sizes can be accommodated by device 10. Bristles 74 will engage a planar surface that is located adjacent to the water jet being cleaned. The bristles can be used to clean the planar surface by manually rotating head 16 in direction 76 or in a counterclockwise direction.

Power for motor 50 can be supplied by a battery pack located inside handle 14 or by utility power via cord 80 and adapter 82. Cord 80 and adapter 82 may also be used as part of a charge unit for a battery in handle 14.

It is to be understood that while certain forms of the present invention have been illustrated and described herein, it is not to be limited to the specific forms or arrangements of parts as described and shown.

What is claimed is:

1. A brush device comprising:

(a) a housing having an opening which is contained in a plane;

(b) an electric motor located inside said housing and having a drive shaft associated therewith, the drive shaft extending from inside said housing toward the opening of said housing;

(c) a plurality of annular brushes mounted on the drive shaft for rotation therewith, the annular brushes being of different diameters, with the largest annular brush being located adjacent to the opening of said housing and the smallest annular brush being located farthest from the opening of said housing, and each annular brush being smaller than those annular brushes that are located closer to the opening;

(d) a cylindrical brush mounted on the drive shaft for rotation therewith, said cylindrical brush being located centrally of each of the annular brushes and extending out of the opening of said housing; and (e) a plurality of cleaning bristles mounted on said housing in surrounding relationship with the opening of said housing.

2. The brush device as described in claim 1 further including a battery pack electrically connected to said electric motor.

* * * * *